US005812101A

United States Patent [19]

Monarchie et al.

[11] Patent Number: 5,812,101

[45] **Date of Patent: *Sep. 22, 1998**

[54] HIGH PERFORMANCE, LOW COST HELMET MOUNTED DISPLAY

[75] Inventors: Dominick L. Monarchie, Norwalk; Thomas J. Rebeschi, North Haven; Russell A. Budzilek, Bridgeport, all of Conn.

[73] Assignee: Northrop Grumman Corporation, Los Angeles, Calif.

[ * ] Notice: The term of this patent shall not extend beyond the expiration date of Pat. No. 5,781,167.

[21] Appl. No.: 626,897

[22] Filed: Apr. 4, 1996

[51] Int. Cl.[6] ..... G09G 5/00

[52] U.S. Cl. ..... 345/8; 345/76; 345/79

[58] Field of Search ..... 345/7, 8, 76, 77, 345/78, 79, 87, 100; 359/13, 630

[56] References Cited

U.S. PATENT DOCUMENTS

| | | | |
|---|---|---|---|
| 3,915,548 | 10/1975 | Opittek et al. | 345/7 |
| 4,722,601 | 2/1988 | McFarlane | 345/8 |
| 4,962,374 | 10/1990 | Fujioka et al. | 345/79 |
| 5,075,596 | 12/1991 | Young et al. | 345/76 |
| 5,438,241 | 8/1995 | Zavracky et al. | 315/169.3 |
| 5,491,510 | 2/1996 | Gove | 345/8 |
| 5,550,557 | 8/1996 | Kapoor et al. | 345/76 |
| 5,654,811 | 8/1997 | Spitzer et al. | 349/106 |

*Primary Examiner*—Matthew Luu
*Attorney, Agent, or Firm*—Walter G. Sutcliff

[57] ABSTRACT

A relatively low cost, portable, low complexity, low power helmet mounted display using an electroluminescent display and associated drive circuitry configured and interconnected to take advantage of our ability to provide a −180 V and +240 V output to a row driver from a single −180 V and an already existing +60 V Supply, thus eliminating size, weight and expense of supplying a separate 240 V power supply. The +60 V power supply is already supplying the +60 V to the column driver circuitry. Also included is a column driver with a direct analog interface with an input buffer, the buffer including a polarity inverter and an adder for selectively inverting the external analog signal and adding a DC voltage.

18 Claims, 4 Drawing Sheets

FIG.2
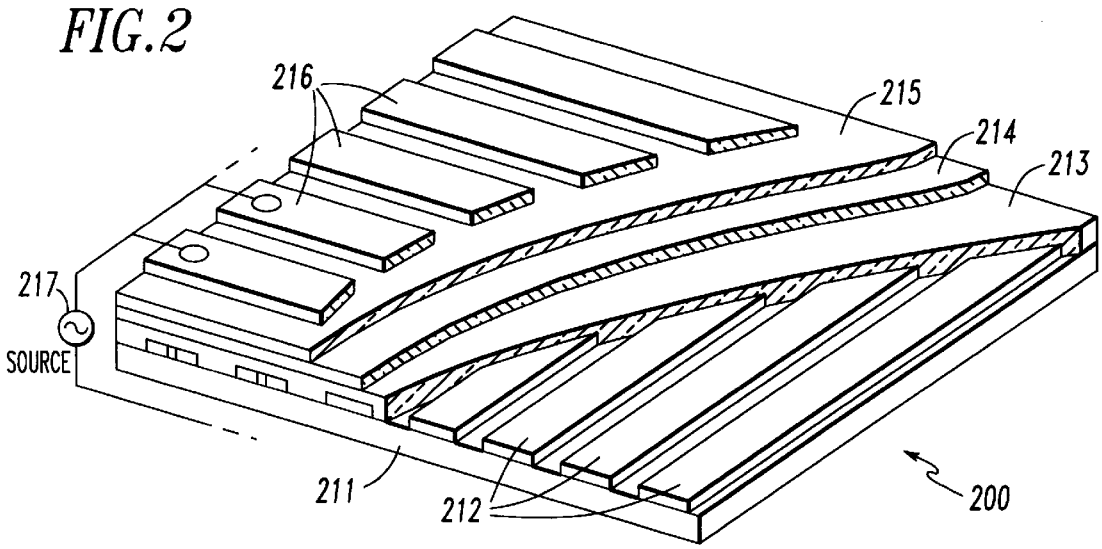
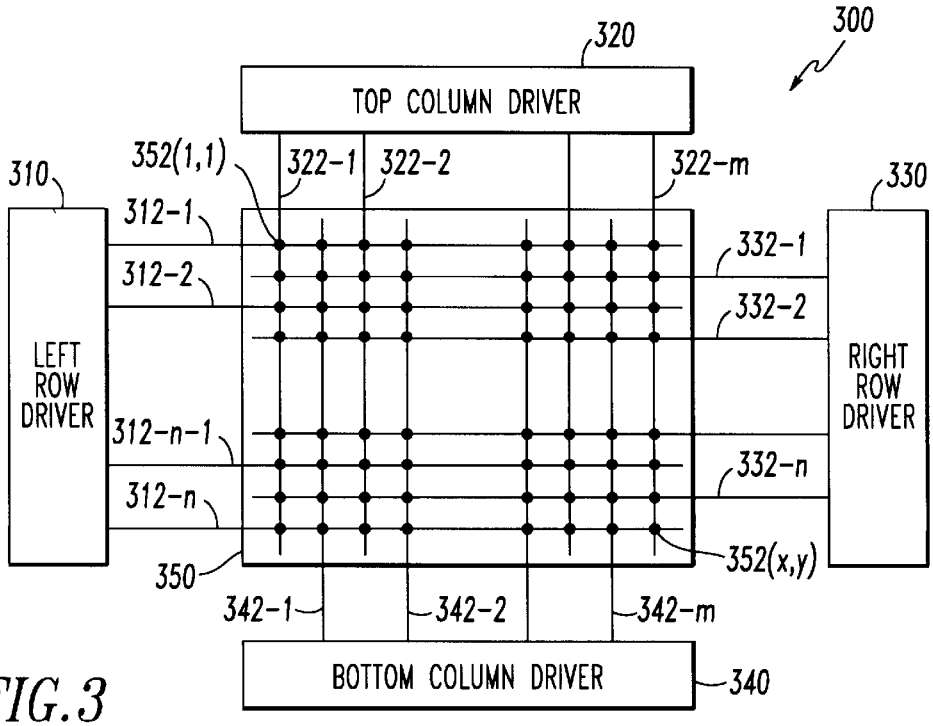
FIG.3

FIG. 5
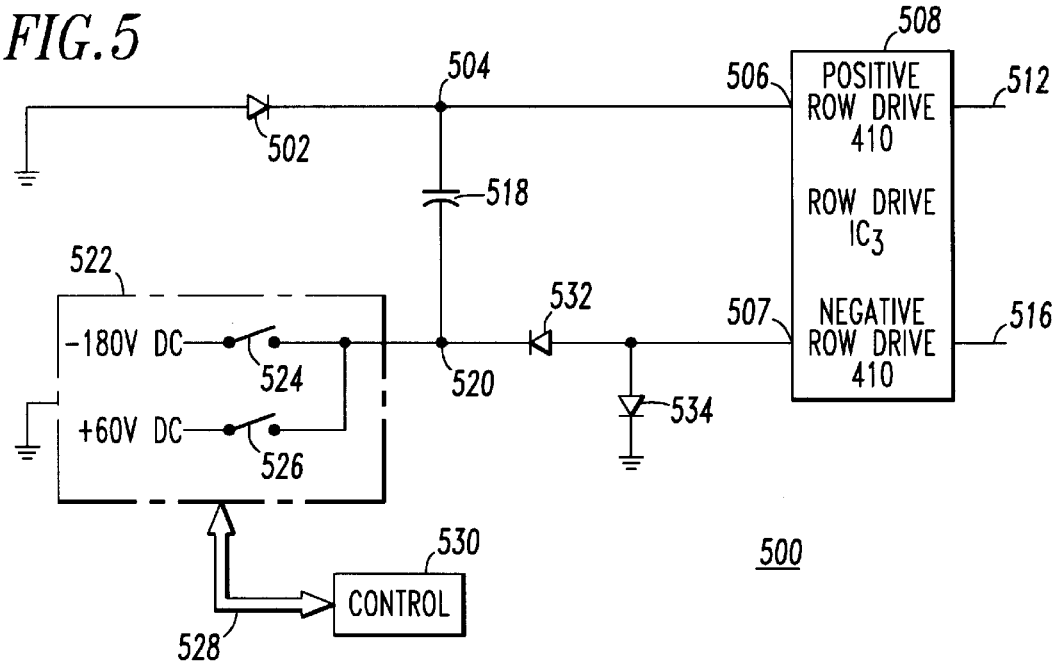
FIG. 6A
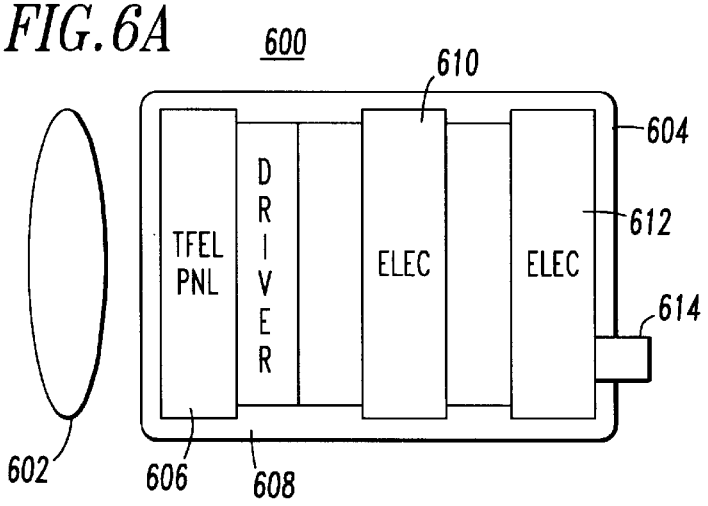
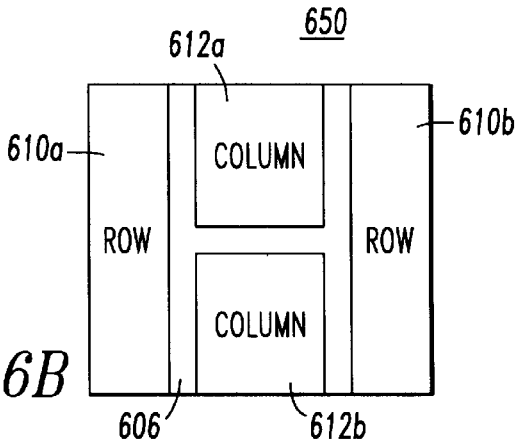
FIG. 6B

HIGH PERFORMANCE, LOW COST HELMET MOUNTED DISPLAY

BACKGROUND OF THE INVENTION

1. Field of the Invention

The present invention relates to apparatus and a method for video displays and more particularly to helmet mounted displays. This application is related to application Attorney Docket No. N-1274, which is a U.S. copending Application Ser. No. 08/626,895 filed concurrently and application Attorney Docket No. N-1276, which is a U.S. copending application No. 08/626,898, filed concurrently, whose specifications are hereby incorporated by reference.

2. Description of the Related Art

Flat panel displays find many applications. Among these are computers, in particular lap-top computers, T.V. screens, video games and various military and space applications. Head mounted flat panel displays are smaller than conventional flat panel displays such as those employed in lap-top computers, T.V. screens and the like. Preferably, head mounted displays (HMDs) are of miniature size, i.e., about one inch square or less.

Most present HMDs employ small cathode ray tubes (CRTs) for displaying visual information to an operator. As a consequence, they are heavy and cumbersome to handle. They also suffer from high power consumption and require high voltages to drive the CRTs. Improved versions of HMDs employ either liquid crystal displays, field effect displays or light emitting diodes (LEDs) for displaying visual information.

Further improved versions of HMDs are hybrids in that they use thin film electroluminescent (TFEL) displays coupled to an active matrix driver to provide a high luminance display adapted for use in daylight. The addition of the active matrix drive layer adds however to the cost, the weight and to the complexity of the resultant high luminance display system. HMDs based on reflection systems on the other hand, in which an image is formed by an LED array and projected to an observer via an optical path, lack the resolution necessary for providing a high quality visual information.

In addition to the requirement for adequate brightness of the display, even in brilliant daylight prevailing in aircraft cockpits, HMDs must meet demanding packaging and interconnect requirements. The smaller the HMD, the more demanding become its packaging and interconnect requirements. In the manufacture of microelectronic devices, which require a large number of electrical connections, a new technology appropriately named flip-chip bump-bond technology was developed to provide such a high yield interconnect despite packaging density. Flip chip bonding lends itself to high packaging densities, faster circuits, and eliminates wire bonding. Various methods to obtain reliable processes are being investigated by many corporations. In general, a metal bump is grown on the chip, the substrate, or both. The chip is flipped over, aligned to the substrate, and bonded.

Flat panel displays, in particular miniature head mounted displays (HMDs), find increased applications, in particular whenever hands-free transfer of video information is desired as for various entertainment, military and space applications.

A need exists for such lightweight, low power, helmet mounted portable display devices and accompanying lightweight, low power and compact display drivers.

It is desirable to solve or ameliorate one or more of the above-described problems in the instant invention.

SUMMARY OF THE INVENTION

In the broadest sense, our invention rests upon our ability to provide a relatively low cost, portable, low complexity, low power helmet mounted display using an electroluminescent display and associated drive circuitry configured and interconnected to take advantage of our ability to provide a −180 V and +240 V output to a row driver from a single −180 V and an already existing +60 V Supply, thus eliminating size, weight and expense of supplying a separate 240 V power supply. The +60 V power supply is already supplying the +60 V to the column driver circuitry. According to a preferred embodiment of the invention, the invention is directed to a driver circuit for an electroluminescent display panel comprising a row driver including positive row drive elements and negative row drive elements, a first power lead with a first predetermined voltage $V_{neg}$ connected in series through a first switch connection to a first node, the first node connected to a first current limiter to the negative row drive elements, a second current limiter operably connected between a first fixed potential to a second node, the second node connected to the positive row drive elements, a third current limiter connected between the negative row drive element and the second fixed potential, a second power lead with a second predetermined voltage $V_{pos}$ connected in parallel to the first node through a second switch connection and a power storage device connected between the first and second nodes, wherein the voltage across the positive and negative row drive elements is selectable, via predetermined operation of the first and second switch connections, between a) $V_{neg}$ and b) the sum of $V_{pos}$ and $V_{neg}$.

Additionally, the invention is directed to a driver circuit for an electroluminescent display panel comprising a column driver including a direct analog interface with an input buffer, the buffer including a polarity inverter and an adder for selectively inverting the external analog signal and adding a DC voltage.

It further includes a driver circuit for an electroluminescent display panel further including a means for output demultiplexing and a plurality of means for sampling and holding a signal, means for comparing an input from the means for sampling and holding to a predetermined variable waveform and means for outputting a compared difference voltage to an analog display output.

Additionally provided is a negative feedback loop for supplying a negative feedback signal from an output terminal of the means for comparing to an input terminal of the means for comparing.

Further features of the above-described intermediate frequency partitioning plan will become apparent from the detailed description hereinafter.

The foregoing features together with certain other features described hereinafter enable the overall system to have properties differing not just by a matter of degree from the any related art, but offering an order of magnitude more efficient use of already existing circuitry.

Additional features and advantages of the invention will be set forth in part in the description which follows, and in part will be obvious from the description, or may be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate preferred embodiments of the apparatus and method according to the invention and, together with the description, serve to explain the principles of the invention.

BRIEF DESCRIPTION OF THE DRAWINGS

FIG. 2 illustrates a Thin Film Electroluminescent Display Panel of the present invention.

FIG. 3 illustrates a Row-Column Driver configuration of the present invention.

FIG. 5 illustrates a Symmetric Row Driver of the present invention.

FIG. 6A illustrates a cross-sectional view of the display portion of the present invention.

FIG. 6B illustrates the rear view of the display panel of the present invention.

DETAILED DESCRIPTION

Figure 1A:
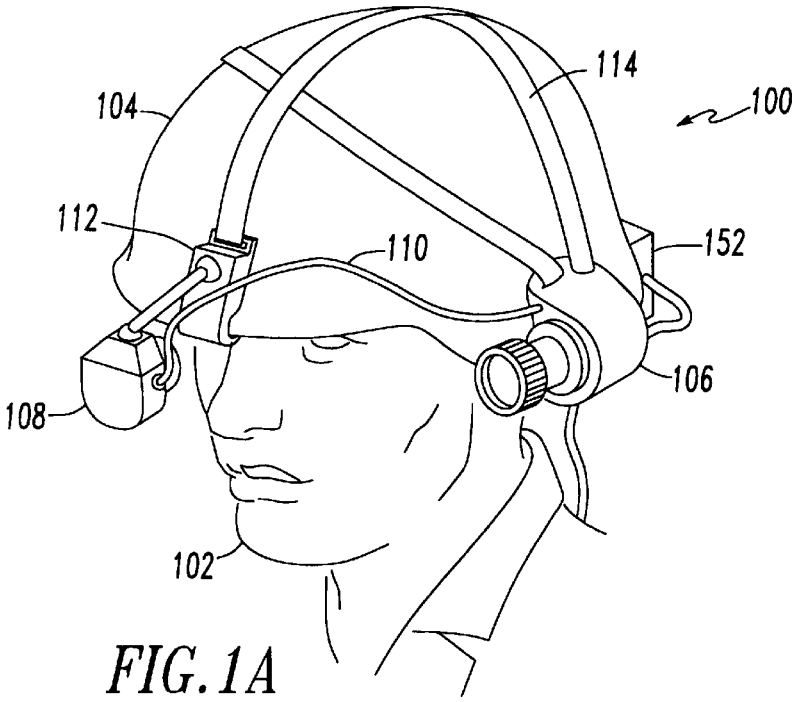
FIG. 1A illustrates an front isometric view of a helmet mounted display configuration of the present invention.

FIG. 1A illustrates a helmet mounted display (HMD) 100 as worn by a person 102. HMD 100 includes a sensor assembly 106 which may be included on helmet 104 itself or may be external to the system. Display 108 which will be presented in more detail late is mounted to helmet 104 through conventional mounting gear including clips 112 and straps 114. Connection link 110 connects input/output electronics 152 through sensor 106 housing to display 108 in the preferred embodiment. Link 110 may be a fiber-optic, wired or wireless connection depending on the system.

Figure 1B:
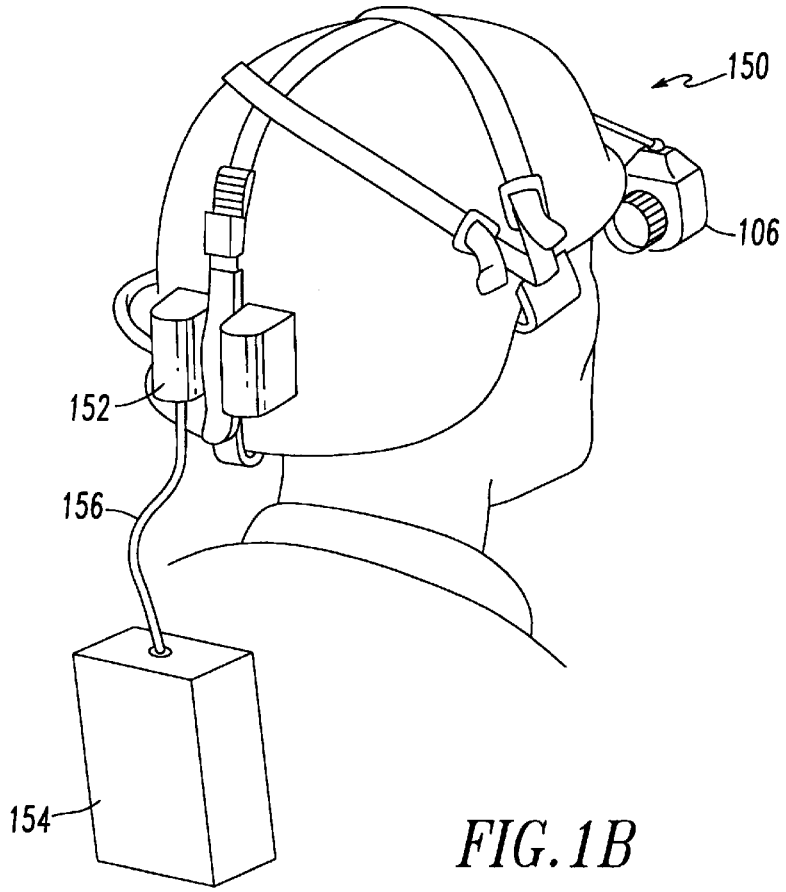
FIG. 1B illustrates a rear isometric view of a helmet mounted display configuration of the present invention.

FIG. 1B illustrates a distributed packaging arrangement 150 for the HMD system. A belt mounted power supply 154 provides the required power via connection 156 and is of a conventional type. Input/output electronics 152 are provided which generate a video signal for transmission to display 108.

A typical thin film electroluminescent (TFEL) structure contained in display portion 108 is constructed from the front (viewing) side to the rear. The thin layers are sequentially deposited on a suitable substrate. Glass substrates are utilized to provide transparency. The transparent front electrodes are typically made from Indium Tin Oxide (ITO) and are deposited on the glass substrate by conventional means, typically by sputtering. The subsequent dielectric-phosphor-dielectric layers are then usually deposited by standard means, again typically by sputtering or evaporation. The phosphor layer is usually annealed after deposition to improve efficiency. The rear electrode may be then added. The finished TFEL laminate is encapsulated in order to protect it from external humidity. Epoxy laminated cover glass or silicon oil encapsulation are used. In that the initial substrate used for deposition is typically glass, the materials and deposition techniques employed in TFEL laminate construction cannot demand high temperature processing.

Referring now to FIG. 2, a thin film electroluminescent (TFEL) display panel 200 includes a glass substrate 211, a plurality of transparent electrodes 212, a first layer of insulating material 213, a layer of electroluminescent material 214, a second layer of insulating material 215 and a plurality of rear electrodes 216. The glass substrate 211 is preferably a borosilicate glass such as CORNING 7059 available from Corning Glassworks of Corning, N.Y. Each of the plurality of transparent electrodes 212 is preferably indium-tin-oxide (ITO) in a preferred embodiment of the present invention and each of the plurality of rear electrodes is Aluminum (Al). The insulating layers 213, 215 include a dielectric material and each layer acts as a capacitor to protect the electroluminescent material 214 from high direct electrical DC currents. The electroluminescent material is typically ZnS doped with Mn.

When a voltage source 217 applies a voltage signal across electrodes 212, 216 respectively, electrons flow and tunnel through layers 213–215 between electrodes 212, 216. These flowing electrons excite the Mn in the electroluminescent material such that the Mn emits photons which pass through both first insulating layer 213 and transparent electrodes 212 to form an image on glass substrate 211 when the magnitude of the voltage level across the electrodes is above a predetermined threshold voltage (e.g. 180 volts).

Referring now to FIG. 3, a TFEL display 300 includes a display panel 350, top and bottom column drivers 320, 340, and left and right row drivers 310, 330. Operably connected to top column driver 320 are top column electrodes 322-1, 322-2 . . . 322-m which extend almost to the bottom portion of display panel 350. In a similar fashion, operably connected to bottom column driver 340 are multiple bottom column electrodes 342-1, 342-2 . . . 342-m which extend almost to the top of display panel 350.

Left row driver 310 is operably connected to multiple left row electrodes 312-1, 312-2 . . . 312-n which extend almost to the far right hand side of display panel 350. Likewise, right row driver 330 is operably connected to multiple right row electrodes 332-1, 332-2 . . . 332-n which extend almost to the far left hand side of display panel 350. Connected to each of the row and column drivers is appropriate analog or digital information inputs (not shown) as the case may be.

The operation of the TFEL display is as follows. Left row driver 310 energizes left row electrode 312-1 with a predetermined write voltage, which in this embodiment is alternately either 240 or −180 V. It should be noted that the write voltage and modulation voltages are application specific and are intended to vary across a wide range of voltages according to the type of TFEL display contemplated. A modulation voltage of 0–60 V is applied to top column driver for placement on top column electrode 312-1. The intersection of the row and column electrodes is pixel 352(1,1). Pixel 352(1,1) is illuminated based on the difference between the row voltage of 240 V and the column modulation voltage of 0–60 V. If a column modulation voltage of 40 V is applied, for example, then the voltage difference of 240−40=200 V is impressed on pixel 352(1,1) giving a corresponding illumination of the pixel. Modulation voltages are applied in a like manner across the intersection of left row electrode 312-1 and bottom column electrode 342-1, followed by top column electrode 322-2 in an alternating fashion on down the line until top column electrode 322-m illuminates pixel 352(1,y) where y is the sum of the mth and nth column.

Successive rows represented by left row electrode 312-x and right row electrode 332-x, where x=1to n, are addressed in similar fashion.

Symmetrically driven TFEL display panel 350 can be operated by applying the same polarity write voltage to each row electrode during a single frame and then reversing the polarity of the write voltage in the next frame. Alternatively, symmetrically driven display panel 350 can be operated by providing write voltages that alternate polarity on a row-by-row basis in one frame, and shift polarities of the applied write voltages in a succeeding frame.

Of course, when the row voltage alternates polarity as described above, the column voltage must be inverted as the brightness of the pixel depends on the voltage difference between the row and column electrodes. Specifically, the column voltage extends from 0 increasing to 60 V when combined with a row voltage of −180 V. and the column voltage then extends from 60 decreasing 0 V when combined with a voltage of +240 V in order to provide the same difference voltage to the individual pixel. For example, if the light emission from a pixel with a +240 V row voltage is desired to be the same as when the +40 V column modulation voltage is used with a −180 V row voltage, as above, then the modulation voltage of 40 V must be inverted (that is, in this embodiment, revolved about an ordinance of 30 V, 30 being half way between 0 and 60) to 20 V in order to generate the same desired intensity. The difference between −180 and 40 is the same as the difference between 240 and 20—both are 220.

Figure 4A:
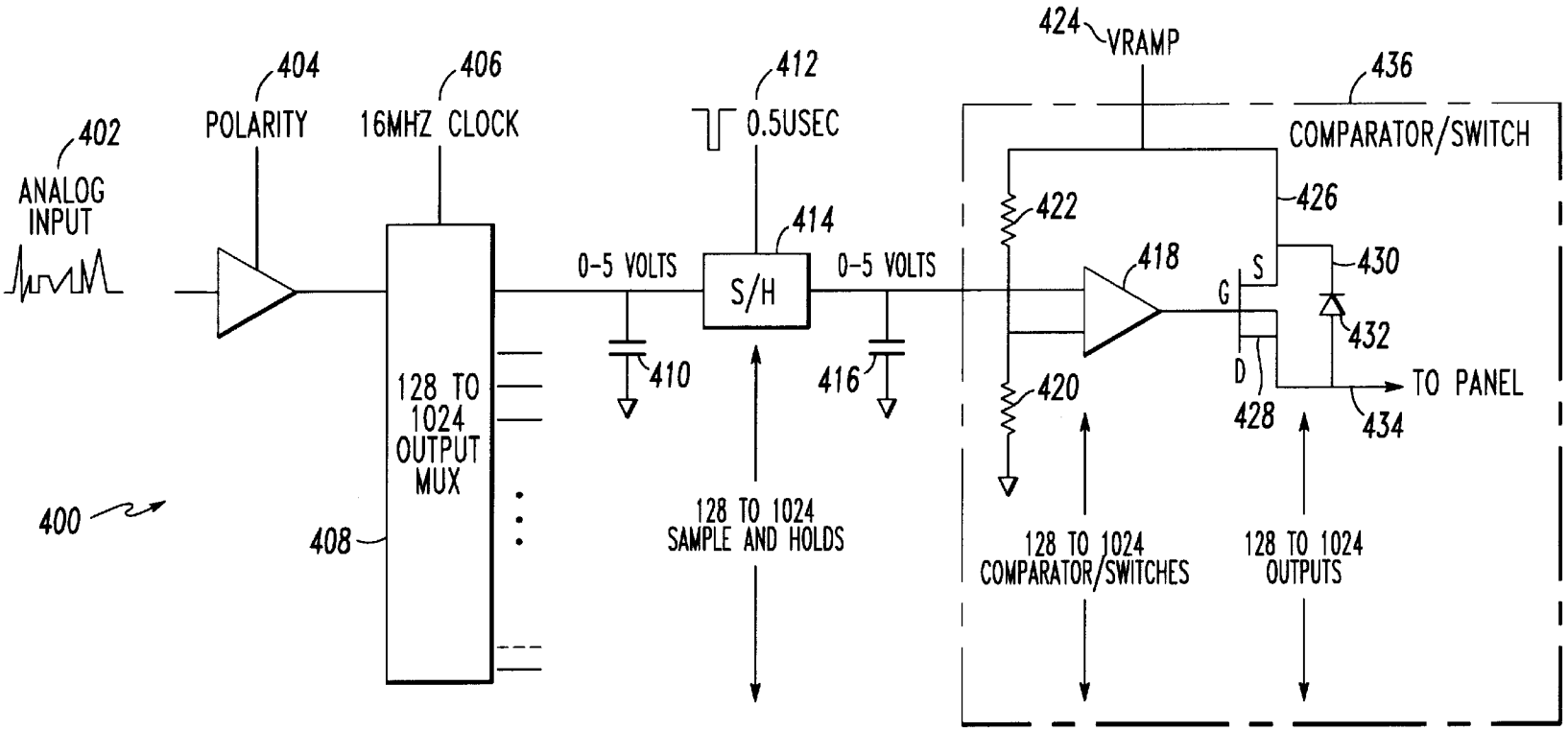
FIG. 4A illustrates a Column Driver of the present invention.

Referring now to FIG. 4A, Column Driver 400 of an embodiment of the present invention includes an analog modulation input 402 connected to polarity inverter 404 for selectively inverting incoming analog modulation input 402. Output multiplexer 408 distributes selectively inverted input 402 to multiple master sample and hold circuits 414 which are connected in a master-slave fashion to slave hold capacitor 416. The sampled and held signal output of capacitor 416 is then input to comparator/switch 436 for output to the electroluminescent display drive panel.

Polarity inverter 404 operates by alternating the column driver voltage on successive frames (or alternately on a row-by-row basis) by inverting the magnitude of the analog input signal and adding an equivalent 60 V DC component to bring the resulting waveform to within 0–60 V. The polarity inverter receives a +1 V video input and provides a +2 V output. The video is then selectively inverted. The inverter may be viewed as revolving the waveform around the ordinate (normally x, or independent variable) axis and moving the waveform above the same ordinate axis by an equivalent offset of 60 V.

Output multiplexer 408 operates as a switch selector to distribute the input analog signal 402 among a plurality of column drivers which typically number between 128 and 1024. Typically a VGA output found in current computer displays has 480 rows by 640 columns.

The sample and hold circuitry is of a conventional nature and is not specific to this design. Any suitable design known to those skilled in the art would suffice. The timing for the sample and hold circuitry is provided from an external controller (not shown). The controller determines the sampling at the specific times in a sequential fashion such that the pixel defined by the intersection row 1 and column 1 is fired, followed by row 1, column 2 etc. in a standard interlaced or non-interlaced fashion depending upon the application. In the preferred embodiment, a standard 480 by 640 VGA display technique is used. Alternatively, the well-known NTSC coding scheme could be used. However, any number of additional well known display techniques may be utilized.

Comparator/switch 436 includes a comparator 418 connected in series with FET switch 428. A first input of comparator 418 accepts an input from sample and hold circuit 414, while a second input of comparator 418 accepts feedback from the source S electrode of FET 428 through a first feedback loop 426 which includes resistor 422 and an input from external input VRAMP 424.

The output of comparator 418 is input to the gate electrode G of FET 428 which acts as a switch to pass VRAMP 424 voltage to output 434 of comparator/switch 436 and on to display panel 350.

Figure 4B:
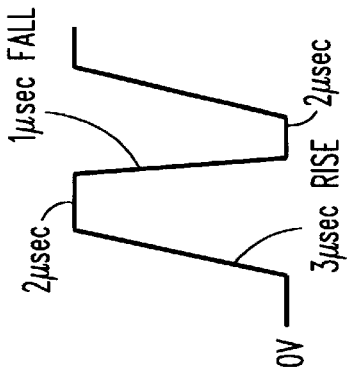
FIG. 4B illustrates a waveform depiction of the generated Ramp voltage of the present invention.

VRAMP 424 waveform is illustrated in FIG. 4B. It is an analog signal that begins at 0 volts, ramps to 60 volts within 3 $\mu$sec, holds steady at 60 V for 2 $\mu$sec, ramps down within 1 $\mu$sec to 0 V for 2 $\mu$sec for a total period of 8 $\mu$sec. The waveform then repeats.

Output multiplexer 408 samples the incoming analog video data stream at an appropriate pixel clock rate and stores the sampled video level on hold capacitors 410. Each pixel is stored on a separate capacitor. The multiplexed capacitors are addressed sequentially from the first video pixel. The video level stored is between 0 and 2 V. After the first row horizontal line of video is sampled and stored on capacitor 410, the sample and hold circuits 414 transfer the data to the second bank of capacitors 416. This transfer is conducted during the master/slave horizontal blanking period. A one horizontal line delay is required to pipeline the data so that input multiplexing and output addressing may be performed simultaneously. This pipelining allows the first bank to begin multiplexing and sampling the next row of input analog video in an efficient manner.

The video information stored on capacitors 416 are applied to the TFEL panel column electrodes simultaneously in parallel. Comparators 418 receive the pixel video level on one input which turns on comparator switch 428. An external VRAMP signal is applied to output switches 428 source S input and output 434 start following VRAMP. The comparator/switch 418 provides a voltage translation from +2V input to the 60 V output required by the TFEL panel.

Resistor divider 422 and 420 provide a reduced ramp input to the comparator. The feedback loop provides the switch point for the output video level. When the divided VRAMP voltage 420 reaches the stored voltage level on capacitors 416 the output switch 428 is turned off and the voltage is held at the output by the panel electrode capacitance. An alternate output stage would require another storage capacitor at output 434 with an additional push-pull buffer circuit to drive the panel capacitance. Such an additional buffer circuit would be provided for larger displays with proportionately higher capacitance.

The output voltage is held for the rest of the horizontal period until the external VRAMP returns to 0 V. Diodes 432 are then forward biased and discharge the panel electrodes to 0 V and the cycle is repeated for the next row.

Referring now to FIG. 5, a Symmetric Row drive 500 of an embodiment of the present invention includes row drive 508 with input terminals 506, 507 and output terminals 512, 516 which deliver output $V_{out}$ to left and right row drivers 310, 330 (connections not shown). Node B 504 is connected to input terminal 506 of positive row drive 510, which is part of row drive 508. Node B 504 is connected to ground through diode 502 which prohibits current flow from node B to ground. Node B 504 is also connected to node A 520 through capacitor 518. Capacitor 518 may be any type of energy storage device(s), either in parallel as illustrated or reconfigured as a serial representation, say, for example as inductor(s).

The inductor configuration provides for energy storage in the form of current which allows the inductor to resonate into a capacitor to create the desired voltages. A feedback network could be provided to maintain the voltage accuracy. The capacitor implementation shown provides a direct translation of the required voltages for the negative and positive symmetric drive voltage transitions of the preferred implementation.

Node A 520 is also connected to external power module 522 which also include switches 524, 526 connected to −180 V and 60 V DC power supplies. The 60 v power supply is already used to supply the modulation voltage to the column drivers 320, 340 of FIG. 3. Switches 524, 526 could also be replaced by a bipolar or MOSFET switching device with an isolated base or gate drive circuit that alternately connects either power supply to node A. An external control circuit 530 is connected to power module 522 to control the switching of the power supplies.

Node A is further connected to row drive ICs input 507 through a diode 532 which restricts current flow in the direction from node A to input 507. Input 507 is connected to ground through diode 534 which conducts current from input 507 to ground.

Referring now to FIG. 6A, display 600 is a preferred embodiment illustrating a detailed view of the general embodiment of display 108 in FIG. 1A. Display 600 includes lens 602 which operates to focus and magnify the image of TFEL panel 606 for close-up viewing. Housing 604 includes connectors 608 in combination with row driver 610 and column driver 612 (shown here functionally) operating to drive TFEL panel 606. External video and power input are provided through a conventional connector 614 located on housing 604.

FIG. 6B illustrates an embodiment of the present invention where row drivers 610*a,b* and column drivers 612*a,b* are mounted on the reverse side of TFEL panel 606. Alternately, row drivers 610*a,b* and column drivers 612*a,b* may be mounted on the edges of a transparent TFEL panel 606 (embodiment not shown) so that the display 600 is essentially transparent when the panel 600 is not being driven.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A helmet mountable thin film electroluminescent display comprising:

a sensor assembly;

a display assembly connected to said sensor assembly by a connection link;

said display assembly further comprising, a thin film electroluminescent display panel;

a row driver circuit connected to the thin film electroluminescent display panel; and a driver circuit for an electroluminescent display panel including, a column driver including a direct analog interface with an input buffer with an input for accepting an external analog signal and an output for outputting an analog signal for said electroluminescent display panel, and wherein said buffer further comprises a polarity inverter for selectively inverting the external analog signal to form an inverted analog signal at a predetermined time depending on a predetermined criteria.

2. A helmet mountable thin film electroluminescent display as in claim 1 wherein the polarity inverter operates to add a predetermined voltage component to the first inverted analog signal to form a second inverted analog signal.

3. A helmet mountable thin film electroluminescent display as in claim 2 wherein the predetermined criteria is determined on a row-by-row basis.

4. A helmet mountable thin film electroluminescent display as in claim 2 wherein the predetermined criteria is determined on a frame-by-frame basis.

5. A helmet mountable thin film electroluminescent display comprising:

a sensor assembly:

a display assembly connected to said sensor assembly by a connection link;

said display assembly further comprising, a row driver including positive row drive elements and negative row driver elements;

a first power lead with a first predetermined voltage Vneg connected in series through a first switch connection to a first node, said first node connected to a first current limiter to said negative row drive elements;

a second current limiter operably connected between a first fixed potential to a second node, said second node connected to said positive row drive elements;

a third current limiter connected between said negative row drive element and said second fixed potential;

a second power lead with a second predetermined voltage $V_{pos}$ connected in parallel to said first node through a second switch connection; and a power storage device connected between said first and second nodes;

wherein the voltage across said positive and negative row drive elements is selectable, via predetermined operation of said first and second switch connections, between a) $V_{neg}$ and b) the difference between $V_{pos}$ and $V_{neg}$.

6. A helmet mountable thin film electroluminescent display as in claim 5 wherein said first current limiter is a diode.

7. A helmet mountable thin film electroluminescent display as in claim 6 wherein said second current limiter is a diode.

8. A helmet mountable thin film electroluminescent display as in claim 7 wherein said third current limiter is a diode.

9. A helmet mountable thin film electroluminescent display as in claim 8 wherein $V_{neg}$ is approximately −180 V.

10. A helmet mountable thin film electroluminescent display as in claim 9 wherein $V_{pos}$ is approximately +60 V.

11. A helmet mountable thin film electroluminescent display as in claim 10 wherein said power storage device is a capacitor.

12. A helmet mountable thin film electroluminescent display as in claim 2 further comprising:

a row driver including positive row drive elements and negative row drive elements;

a first power lead with a first predetermined voltage $V_{neg}$ connected in series through a first switch connection to a first node, said first node connected to a first current limiter to said negative row drive elements;

a second current limiter operably connected between a first fixed potential to a second node, said second node connected to said positive row drive elements;

a third current limiter connected between said negative row drive element and said second fixed potential;

a second power lead with a second predetermined voltage $V_{pos}$ connected in parallel to said first node through a second switch connection; and a power storage device connected between said first and second nodes;

wherein the voltage across said positive and negative row drive elements is selectable, via predetermined operation of said first and second switch connections, between a) $V_{neg}$ and b) the difference between $V_{pos}$ and $V_{neg}$.

13. A helmet mountable thin film electroluminescent display as in claim 12 wherein said first current limiter is a diode.

14. A helmet mountable thin film electroluminescent display as in claim 13 wherein said second current limiter is a diode.

15. A helmet mountable thin film electroluminescent display as in claim 14 wherein said third current limiter is a diode.

16. A helmet mountable thin film electroluminescent display as in claim 15 wherein $V_{neg}$ is approximately −180 V.

17. A helmet mountable thin film electroluminescent display as in claim 16 wherein $V_{pos}$ is approximately +60 V.

18. A helmet mountable thin film electroluminescent display as in claim 17 wherein said power storage device is a capacitor.

* * * * *